United States Patent [19]

Wagner

[11] 3,967,747

[45] July 6, 1976

[54] BOTTLE SUPPORT TRAY OF MOISTUREPROOF MATERIAL FOR A BOTTLE CASE

[75] Inventor: Gary L. Wagner, Covington, La.

[73] Assignee: Crown Zellerbach Corporation, San Francisco, Calif.

[22] Filed: June 9, 1975

[21] Appl. No.: 585,031

Related U.S. Application Data

[62] Division of Ser. No. 385,856, Aug. 6, 1973.

[52] U.S. Cl. ..... 217/26.5; 206/519

[51] Int. Cl.[2] ..... B65D 21/02; B65D 81/16

[58] Field of Search ..... 206/427, 509, 519, 520; 217/26.5

[56] References Cited

UNITED STATES PATENTS

| | | | |
|---|---|---|---|
| 2,414,171 | 1/1947 | Scharff | 220/21 |
| 2,475,924 | 7/1949 | Suiter | 206/427 X |
| 2,704,974 | 3/1955 | Setman | 206/519 |
| 2,735,607 | 2/1956 | Wasyluka | 206/520 X |
| 2,876,898 | 3/1959 | Schmidt | 206/392 |
| 3,349,943 | 10/1967 | Box | 206/509 X |
| 3,401,863 | 9/1968 | Earl | 229/2.5 |
| 3,490,679 | 1/1970 | Heller et al. | 229/23 |
| 3,539,552 | 11/1970 | Mounts, et al. | 206/519 |

*Primary Examiner*—Leonard Summer

*Attorney, Agent, or Firm*—Thomas R. Lampe; Corwin R. Horton

[57] ABSTRACT

A bottle carrier case comprises a wall part and a bottle support tray part of moistureproof material fixedly attached together. The wall part is formed of multiwall panels, and the tray part has upstanding flanges along its edges secured to the wall part between the wall panels. Ledges on the tray part engage lower edges of wall part panels to prevent contact of such edges upon a support surface on which the tray part may be supported thus preventing wicking of moisture on such surface through the wall edges which are preferably of paperboard. Bottle support platforms extend from the top surface of the tray part upon which bottles are supported, leaving shallow recess thereunder to accommodate the tops of bottles, thus permitting cross stacking of cases. Reinforcing ribs are provided about each support platform; and suitable drainage passages and openings are also provided for escape of liquids.

10 Claims, 12 Drawing Figures

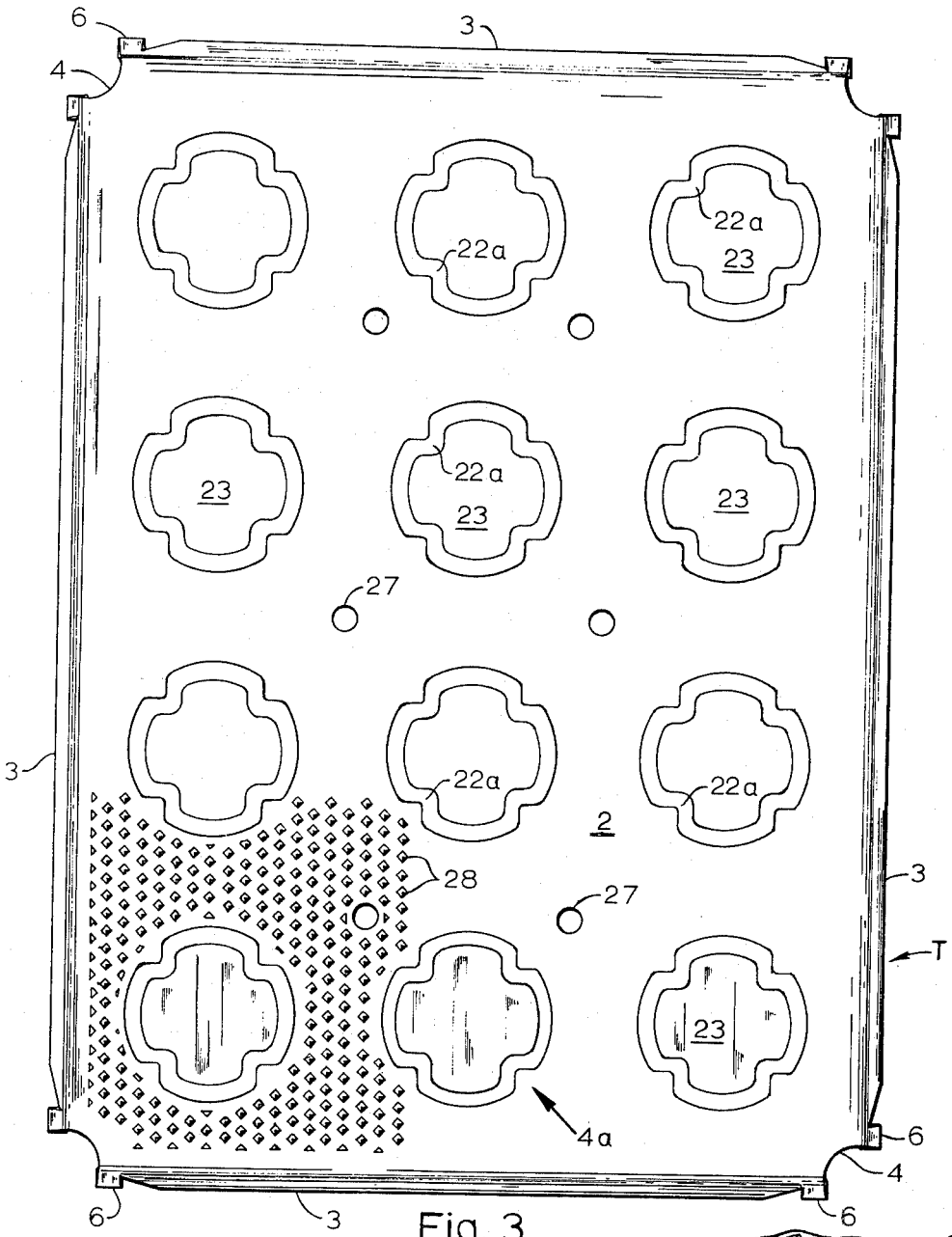
Fig. 3
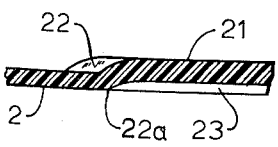
Fig. 4b
Fig. 4a
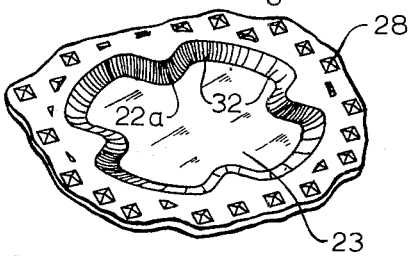
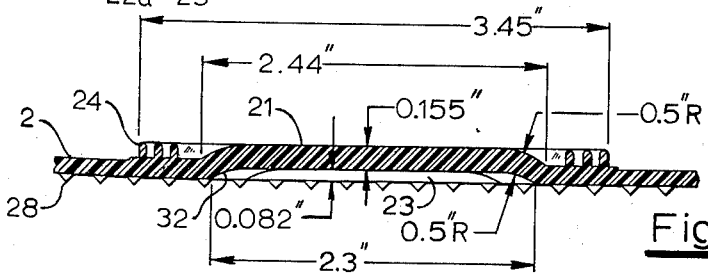
Fig. 4

W
T
14
16
12
13
3
6
8
7
4
2

BOTTLE SUPPORT TRAY OF MOISTUREPROOF MATERIAL FOR A BOTTLE CASE

RELATED APPLICATION

This application is a division of applicant's copending application, Ser. No. 385,856, filed Aug. 6, 1973.

SUMMARY AND OBJECTS OF THE INVENTION

Summarizing the invention, the bottle carrier case comprises paperboard walls each formed of hingedly connected spaced apart panels. A tray of moistureproof material is fixedly connected to the walls to provide a moisture resistant bottom. Flanges upstanding from the edges of the tray are each secured between the panels of a wall by suitable means such as stitching in the form of metal staples. Ledges integral with the tray extend outwardly beyond the outer faces of the upstanding flanges, and are provided with support surfaces above the plane of the bottom of the tray, which are engaged with the bottom edges of the outside wall panel surfaces to prevent contact of such wall edges with a surface upon which the bottom of the tray may be supported. Thus, should the support surface be wet the lower edges of the walls are completely protected against wicking of moisture.

The tray is of integrally molded plastic material; and the top surface of the tray is formed with integral bottle support platforms upstanding from the top surface of the bottom panel of the tray forming smooth elevated flat bottle support surfaces. A shallow recess is also formed underneath each platform for accommodating the tops of bottles of stacked cases under the elevated tops of platforms. This enables ready cross stacking of filled cases.

Desirably, each platform is substantially circular in shape, and substantially equispaced recesses project inwardly from the edge of the platform, leaving inwardly projecting reinforcing projections under such inwardly projecting recesses. The edges of the shallow bottle-top accommodating recess and of the reinforcing projections are sloped and smooth to prevent the tops of bottles in stacked cases from catching on such edges when a top case is removed by sliding it off the stack.

Reinforcing ridges are provided about each platform; they are interrupted by drainage channels opposite the respective inwardly projecting recesses at the edge of each elevated platform, to allow drainage of liquid; and the bottom panel of the tray is formed with drainage holes. Drainage notches are also provided at each corner of the tray with a wall supporting ledge at each of a notch.

From the preceeding, it is seen that the invention has as its objects, among others, the provision of an improved bottle carrier case which, although the walls thereof are desirably of material which can absorb moisture, is provided with a moisture proof bottle support tray unit fixedly secured to the case walls and having means to prevent bottom edges of the walls from contacting a surface upon which the tray may be supported thus precluding wicking of moisture through such wall edges, is of such construction as to permit ready cross stacking of cases, is provided with suitable drainage passages and openings, and which is of simple and economical construction. Other objects will become apparent from the following more detailed description and accompanying drawings, in which:

DESCRIPTION OF DRAWINGS

FIG. 3 is a bottom plan view of the tray, with minute projections or knobs which are on the bottom surface of the tray being shown only at the lower left-hand corner of the FIG.;

FIG. 4 is a fragmentary vertical section taken in a plane indicated by line 4—4 in FIG. 1;

FIG. 4*a* is a fragmentary isometric view of a bottom portion of the tray looking in the direction of arrow 4*a* in FIG. 3;

FIG. 4*b* is a fragmentary vertical section taken in a plane indicated by line 4*b* — 4*b* in FIG. 1;

DETAILED DESCRIPTION

The bottle carrier case hereof is particularly adapted for holding and transporting bottles containing beverages such as soft drinks or beer; and in the particular embodiment of the invention described it is adapted for holding 12 1-qt. bottles which are the usual quart bottle size. It comprises a tray part T and a wall part W which are permanently connected together in a manner to be described so that the case is reuseable again and again. The tray part is made entirely of moistureproof material, such as high impact, high density polyethylene or any other suitable material, desirably plastic which can be molded into a unitary structure and which possesses high crack resistance because cases of the character hereof are freqently handled roughly. A suitable preferred material is Phillip's Polyethylene BMD-5040.

Figure 1:
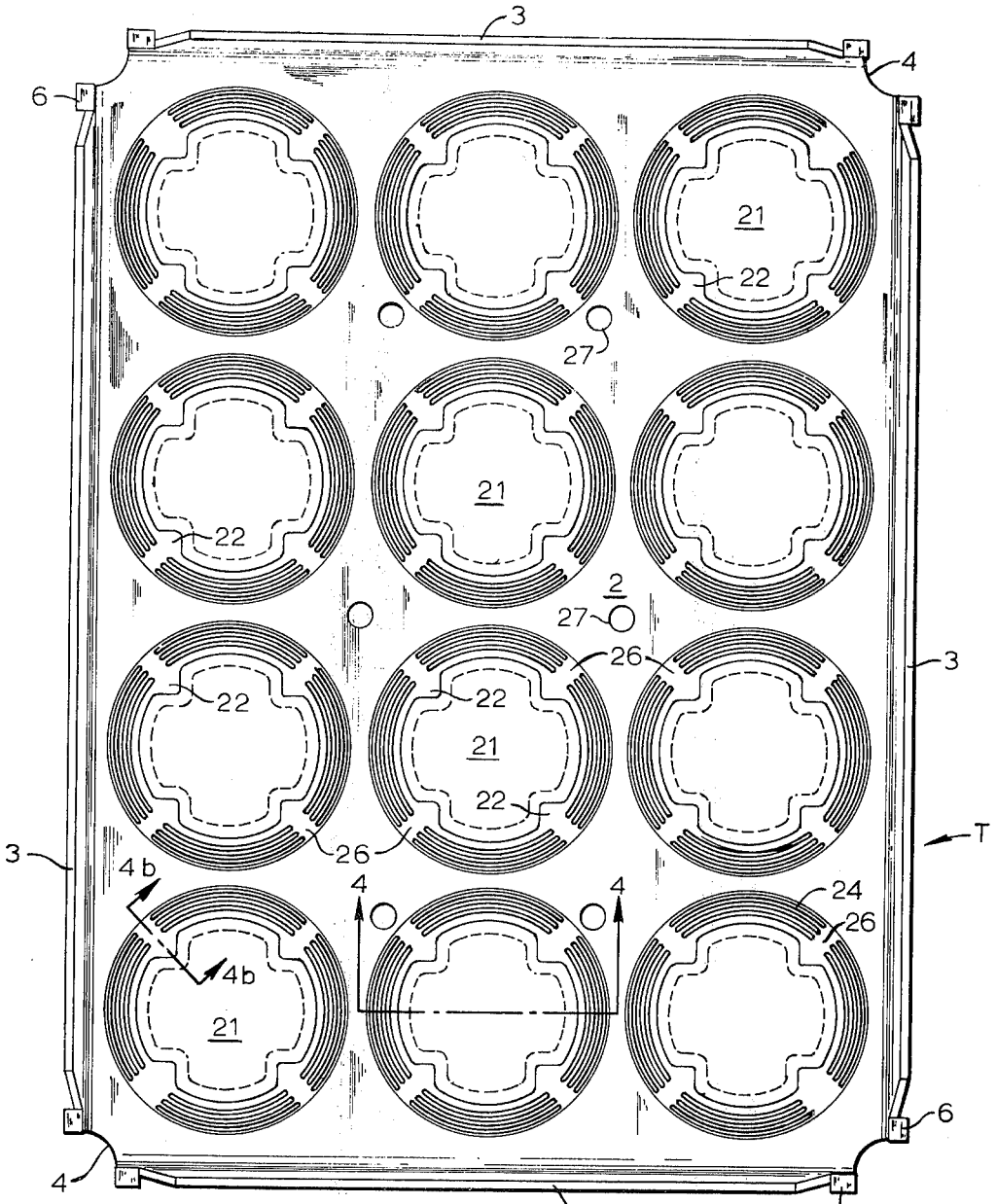
FIG. 1 is a top plan view of the tray part for attachment to walls of the carrier case.
Figure 2:
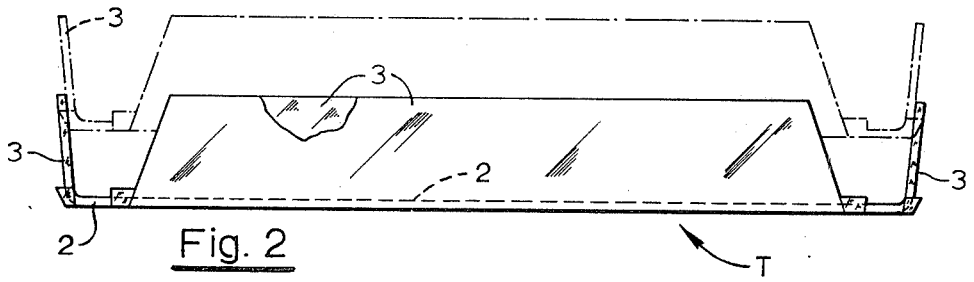
FIG. 2 is an end elevation with a portion of an upstanding flange at the end of the tray being shown broken away, and a stacked overlying tray being illustrated in phantom lines.
Figure 5:
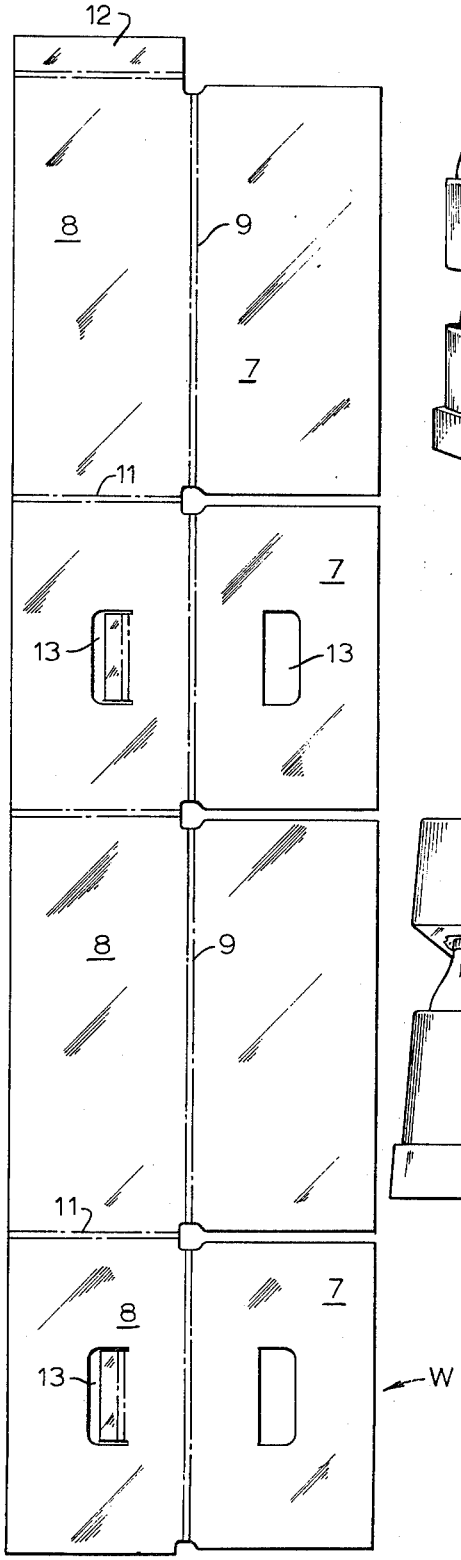
FIG. 5 is a plan view of the blank from which the wall portion of the case is made.

With particular reference to FIGS. 1, 2 and 3, the tray part comprises a bottom panel 2 which has specially shaped top and bottom surface configurations to be described in detail hereinafter, and which is of generally rectangular shape. An upstanding flange 3 is integrally connected along each side edge of the tray and provides for attachment to walls of the carrier case in a manner to be described. Flanges 3 are inclined slightly outwardly to allow stacking of adjacent trays during shipment or storage, as can be seen from FIG. 2, but have limited lateral flexibility to facilitate attachment to all walls of a case. The adjacent ends of flanges 3 at each corner are inclined inwardly from their bottoms, and are spaced apart while a drainage notch 4 is provided at each corner of bottom panel 2 between the flange ends at the corner.

At each corner are a pair of spaced apart ledges 6 which extend laterally outwardly beyond the outer faces of the securing flanges 3. Each of ledges 6 is at and substantially in alinement with the bottom of the tray and is integral with the end of an upstanding securing flange at the corner. The upper surface of each of the ledges 6 is flat; and the ledges provide support surfaces above the plane of the bottom surface of the tray to engage bottom edges of outer wall panels of the case and support them above the bottom surface of the tray.

Reference is made particularly to FIGS. 5, 6, 7 and 8 which illustrate how the tray unit is fixedly attached to the wall unit of the carrier case. The walls of the case are formed from the blank (desirably solid paperboard) illustrated in FIG. 5 which is of more or less conventional construction comprising integrally connected wall panels of which the right-hand panels 7 appearing in the view are foldable inwardly over left-hand panels 8 along hinge connection line 9. When thus folded panels 7 form inner wall panels and panels 8 form outer wall panels of the case. Transverse hinge connection lines 11 enable folding to form end and side walls while a hingedly connected securing flap 12 is provided at the end of one of the inner wall panels 8. Usual hand holes 13 are formed in the end panels; and for enhancing strength a metal reinforcing rim 14 is provided over which the wall panels are folded.

Thus, it can be seen that each wall of the case is a multi-ply wall formed of spaced apart inner and outer panels. To complete the case each upstanding flange 3 of the tray part is positioned between the inner and outer panels of a wall with the outer panel 8 supported in engagement with the flat upper surfaces of spaced apart ledges 6 as can be seen best from FIGS. 7 and 8. The entire two-part assembly is rigidly fastened together by suitable fastening means, preferably metal staples 16 which extend through the inner and outer panels of each wall and through a tray securing flange 3 between such panels.

It will be noted that when a bottom of a case rests on a support surface such as a floor or pallet, the lower edges of the paperboard walls are maintained above the plane of the bottom surface of the tray, and are thus prevented from contacting such surface. Hence, should the support surface be wet, moisture cannot penetrate the moistureproof bottom of the tray and wick through the lower edges of the paperboard walls. In this connection, support ledges 6 of the tray part also serve as stops to insure that the lower edges of the outer wall panels 8 cannot project below the plane of the bottom surface of the tray.

Means is provided to support the bottoms of bottles on the tray part, and to provide for drainage of liquid from the tray which may be present, and also to reinforce the entire tray. Referring to FIGS. 1 through **4*a*, the embodiment illustrated provides for support of 12 bottles in the usual parallel transversely and longitudinally longitudinally extending grow and rows, with four bottles in a longitudinally extending row and three bottles in a transversely extending row. Each bottle is supported on an integrally molded support platform 21 upstanding a slight distance from the top of the tray bottom panel 2, and having a flat, relatively smooth top surface. Thus the platform is elevated above the top surface of bottom panel 2. Desirably it is substantially circular in shape with a plurality of recesses indentations 22 which are equispaced about the platform and project inwardly from the edge of the platform. As can be seen best from FIGS. 4 and 4*a* each upstanding platform 21 forms a relatively shallow recess 23 under the flat and smooth undersurface of the platform, for accommodating tops of bottles in stacked cases thereof; and the upper recesses 22 extending inwardly from the edge of each platform 21 provide inwardly projecting reinforcing projections 22*a* under the respective recesses 22.**

Preferably four equispaced recesses 22 and projections **22*a* are provided; and they are advantageously triangular in shape, desirably right angular, because projections 22*a* of such shape have been found to impart enhanced reinforcement. However, any number of these indentations of any other suitable shape may be employed. For additionally imparting strength, at least one row of a reinforcing ribs 24, and desirably three rows are provided about each support platform 21. Ribs 24 are interrupted with drainage channels 26 which are opposite the respective recesses 22 to allow ready drainage of liquid. In addition to the corner drainage notches 4, panel 2 of the tray is provided with drainage holes 27. The bottom surface of the tray is formed with multiplicity of integral small projections or knobs 28 about shallow recesses 23,** which provide a friction surface facilitating transportation of a filled case over conveyors such as rollers or rubber belts, thus minimizing slippage.

The bottoms of the bottles are supported on the elevated platforms 21, and their peripheries may extend over reinforcing ribs 24. Usually, partitions of conventional character are provided in the case to form cells for the respective bottles.

Figure 9:
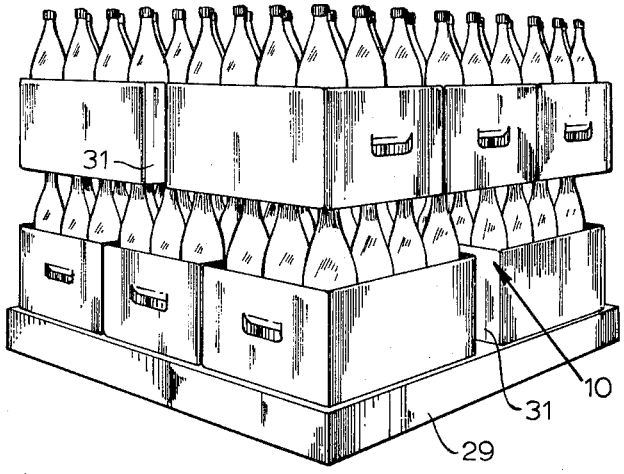
FIG. 9 is a schematic isometric view illustrating a manner of cross stacking cases.
Figure 10:
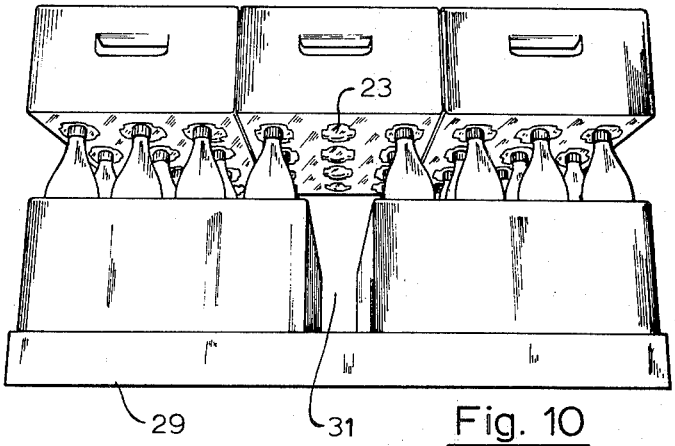
FIG. 10 is an elevational view looking in the direction of arrow 10 in FIG. 9.
Figures 6, 7, 8:
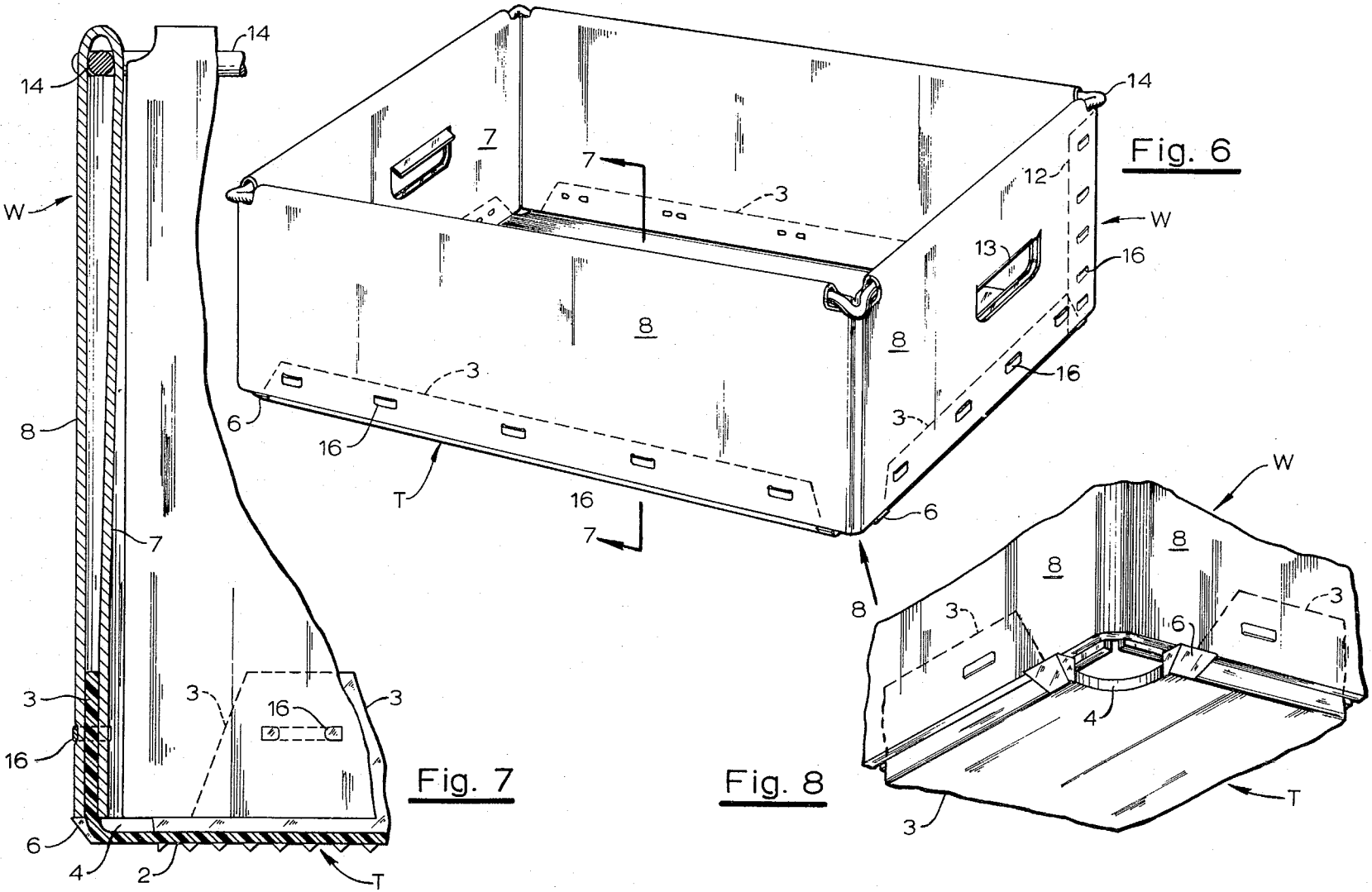
FIG. 6 is an isometric view of the bottle carrier case with the parts thereof fixedly assembled.
FIG. 7 is an enlarged vertical cross section taken in a plane indicated by line 7—7 in FIG. 6.
FIG. 8 is an enlarged fragmentary isometric view looking at the corner of the bottom of the case as indicated by the direction arrow 8 in FIG. 6.

As previously related, recesses 23 under the respective platforms 21 are relatively shallow but are of sufficient depth to provide adequate space for receiving the bottle-tops to maintain stability and prevent undue shifting of stacked cases containing bottles. However, they are not so deep that the tops of bottles will catch along edges of the recesses when cases are pulled off of a stack thereof. A suitable depth is about 0.06 to 0.10 inch. The recesses facilitate cross stacking, and are particularly advantageous when cases are cross stacked in the manner shown in FIGS. 9 and 10. It will be noted from these Figs. that in cross stacking, for example on a pallet 29, a space 31 is provided between the ends of cases in each tier of the stack with a cross stacked case in an overlying tier spanning such space, while the sides of the cases in each tier abut.

As a result, all the bottle-tops may not be accurately centered but the shallow recesses 23 accommodate the bottle-tops even though centering thereof in their respective recesses may not occur. In this connection, if a bottle-top is near the edge of a recess 23 when the cases are cross stacked, the inwardly projecting tray reinforcing projections **22*a*** at the under side of the tray also serve as limit stops to prevent undue shifting. The cases may also be stacked with all extending in the same direction but cross stacking provides greater stability.

In removing cases from a stack, they may be pulled off by sliding; and to preclude the bottle-tops, particularly when they are capped, from catching along the edges of recesses 23 and projections **22*a*, these edges are molded relatively smooth and with a slant as is indicated by reference numeral 32 in FIGS. 4 and 4*a***. This can be readily accomplished by molding such edges with a relatively large radius.

In the embodiment of the invention illustrated, which is adapted for conventional 12 one quart bottles, the case is of conventional size of about 15 ¼ inches in length, 11 ½ inches wide, and about 7 inches high. The shallow recesses 23 under support platforms 21 have the following typical dimensions indicated in FIG. 4: about 2.3 inches outside diameter, a depth of about 0.082 inch, with a wall thickness of the tray and consequently of elevated platform 21 about 0.125 inch, and slanting edges 32 molded on about 0.5 inch radius. The outside diameter of platform 21 at its lower edge is typically about 2.44 inches, and the radius of its upper edge surface is also about 0.5 inch. The overall diameter between the outer surfaces of outer ribs 24 is about 3.45 inches.

These dimensions are not critical and may vary depending upon the size of the tray and the type of bottles which it is intended to support but are given merely by way of example as illustrative of relative proportions. It is only desirable that the recesses 23 are relatively shallow having smooth flat under surfaces, and that the tops of platform 21 be also relatively smooth and flat.

I claim:

1. A bottle support tray of integrally molded moistureproof plastic material for providing the bottom of a bottle carrier case, comprising a bottom panel having side edges, upstanding flanges attached to said edges for attachment to walls of the carrier case, and a plurality of spaced apart ledges integral with and projecting laterally outwardly beyond the outer faces of said flanges with each ledge substantially in alinement with said panel, said ledges having support surfaces above the plane of the undersurface of said panel adapted to engage the bottom edges of the carrier case walls to maintain the carrier case wall bottom edges out of contact with a surface upon which the case may be supported, parallel transversely and longitudinally extending rows of bottle support platforms upstanding from the top of said panel and integral therewith; each platform being elevated a slight distance above the top surface of the panel and having a relatively flat smooth top surface and spaced apart recesses projecting inwardly from its edge; the undersurface of said panel having a smooth shallow bottle-top accommodating recess under the elevated portion of said platform, and inwardly projecting projections under said edge recesses.

2. The bottle support tray of claim 1 wherein the edges of said bottle-top accommodating recess and said projections are sloped and smooth to preclude the tops of bottles in stacked cases from catching on said edges when a top case is removed from the stack.

3. The bottle support tray of claim 2 wherein said platform is substantially circular in shape, the inwardly projecting edge recesses are substantially triangularly shaped and substantially equispaced apart, and the platform is surrounded by at least one row of ribs interrupted by drainage channels.

4. The bottle support tray of claim 3 wherein a plurality of rows of ribs is provided, which are interrupted by drainage channels, each drainage channel is opposite an inwardly projecting recess, and the panel is provided with drainage holes.

5. The bottle support tray of claim 1 wherein said upstanding flanges are inclined slightly outwardly to allow stacking of adjacent trays but have limited lateral flexibility to facilitate attachment to walls of a case, and the corners of the bottom panel are notched to allow drainage of liquid.

6. The bottle support tray of claim 5 wherein a pair of spaced apart support ledges is provided adjacent each corner notch.

7. A bottle support tray of integrally molded moistureproof plastic material for providing the bottom of a bottle carrier case comprising a bottom panel having side edges, upstanding flanges rigidly attached to said edges for attachment to the walls of a carrier case, the adjacent ends of said flanges at the corners of the tray being spaced apart, and a pair of spaced apart support ledges adjacent the bottoms of said flange ends integral with and projecting laterally outwardly beyond the outer faces of the flanges with each ledge substantially in alinement with the bottom panel, said ledges having support surfaces above the plane of the bottom surface of said tray and engageable with bottom edges of walls of a case to prevent contact of said wall edges with a surface upon which the tray may be supported.

8. The bottle support tray of claim 7 wherein each corner of the tray is provided with a drainage notch between the ledges at the corner.

9. The bottle support tray of claim 7 wherein parallel transversely and longitudinally extending rows of bottle support platforms extend from the top of said tray panel and are integral therewith; each platform being elevated a slight distance above the top surface of the panel and having a relatively flat smooth top surface and substantially equispaced substantially triangularly shaped recesses projecting inwardly from its edge; the undersurface of said panel having a smooth shallow bottle-top accommodating recess under the elevated portion of said platform, and inwardly projecting triangularly shaped projections under said triangularly shaped recesses.

10. A bottle support tray of integrally molded moistureproof plastic material comprising a bottom panel having side edges, upstanding flanges integrally connected to said edges of the bottom panel for attachment to the walls of a carrier case, said upstanding flanges being inclined slightly outwardly to allow stacking of the trays one on top of the other and having limited flexibility to facilitate attachment to the side walls of a case, and a pair of spaced apart ledges at each corner of the tray integral with and projecting outwardly beyond the outer faces of said tray flanges with each ledge substantially in alinement with the bottom panel of the tray at an end of an upstanding tray flange, said ledges having support surfaces above the plane of the bottom of the tray engageable with bottom edges of side walls of a carrier case to position said wall edges out of contact with a surface upon which the bottom of the tray may be supported to thus prevent wicking of moisture through such wall edges should said surface be wet.

* * * * *